US012281376B2

(12) United States Patent
Matsunaga et al.

(10) Patent No.: US 12,281,376 B2
(45) Date of Patent: *Apr. 22, 2025

(54) SLIT COPPER MATERIAL, PART FOR ELECTRIC/ELECTRONIC DEVICE, BUS BAR, HEAT DISSIPATION SUBSTRATE

(71) Applicant: MITSUBISHI MATERIALS CORPORATION, Tokyo (JP)

(72) Inventors: Hirotaka Matsunaga, Kitamoto (JP); Kosei Fukuoka, Kitamoto (JP); Kazunari Maki, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 29 days.

This patent is subject to a terminal disclaimer.

(21) Appl. No.: 18/044,005

(22) PCT Filed: Oct. 20, 2021

(86) PCT No.: PCT/JP2021/038772

§ 371 (c)(1),
(2) Date: Mar. 3, 2023

(87) PCT Pub. No.: WO2022/085723

PCT Pub. Date: Apr. 28, 2022

(65) Prior Publication Data

US 2023/0313342 A1 Oct. 5, 2023

(30) Foreign Application Priority Data

Oct. 23, 2020 (JP) ..... 2020-178070
Oct. 19, 2021 (JP) ..... 2021-170961

(51) Int. Cl.
*C22C 9/00* (2006.01)
*C22C 1/03* (2006.01)
(Continued)

(52) U.S. Cl.
CPC ..... *C22C 9/00* (2013.01); *C22C 1/03* (2013.01); *C22F 1/02* (2013.01); *C22F 1/08* (2013.01); *Y10T 428/12431* (2015.01)

(58) Field of Classification Search
None
See application file for complete search history.

(56) References Cited

U.S. PATENT DOCUMENTS

2018/0040389 A1* 2/2018 Matsunaga ..... C22F 1/08
2019/0048449 A1* 2/2019 Matsunaga ..... C22F 1/08

FOREIGN PATENT DOCUMENTS

EP 3896179 A1 10/2021
JP 2010100890 A * 5/2010
(Continued)

OTHER PUBLICATIONS

International Search Report mailed Dec. 21, 2021 for the corresponding Patent Application No. PCT/JP2021/038772 (4 pages including English translation).
(Continued)

*Primary Examiner* — Seth Dumbris
(74) *Attorney, Agent, or Firm* — Leason Ellis LLP; Melvin C. Garner; Mitsuhiro Haraguchi

(57) ABSTRACT

A slit copper material comprises 99.96% by mass or greater of Cu. In this slit copper material, a ratio W/t of a plate width W to a plate thickness t is 10 or greater, an electrical conductivity is 97.0% IACS or greater, a ratio B/A of an average crystal grain size B in a plate surface layer portion to an average crystal grain size A in a plate center portion is in a range of 0.80 or greater and 1.20 or less, and the average crystal grain size A in the plate center portion is 25 μm or less.

11 Claims, 1 Drawing Sheet

(51) Int. Cl.
*C22F 1/02* (2006.01)
*C22F 1/08* (2006.01)

(56) References Cited

FOREIGN PATENT DOCUMENTS

| | | | | | |
|---|---|---|---|---|---|
| JP | 2013004444 | A | | 1/2013 | |
| JP | 2013067848 | A | | 4/2013 | |
| JP | 2013067878 | A | | 4/2013 | |
| JP | 2014058705 | A | | 4/2014 | |
| JP | 2018016823 | A | | 2/2018 | |
| TW | 201807209 | A | | 3/2018 | |
| WO | 2017170699 | A1 | | 10/2017 | |
| WO | 2018062255 | A1 | | 4/2018 | |
| WO | WO-2018181593 | A1 | * | 10/2018 | ..... C22C 9/00 |
| WO | WO-2020122112 | A1 | * | 6/2020 | ..... C04B 37/021 |

OTHER PUBLICATIONS

U.S. Office Action mailed Aug. 29, 2024 for the related U.S. Appl. No. 18/245,097 (14 pages).
International Search Report mailed Dec. 21, 2021 for the related International Patent Application No. PCT/JP2021/038742 (4 pages including English translation).
Taiwanese Office Action mailed Feb. 11, 2025 for the corresponding Taiwanese Patent Application No. 110139221 (6 pages including English translation).

* cited by examiner

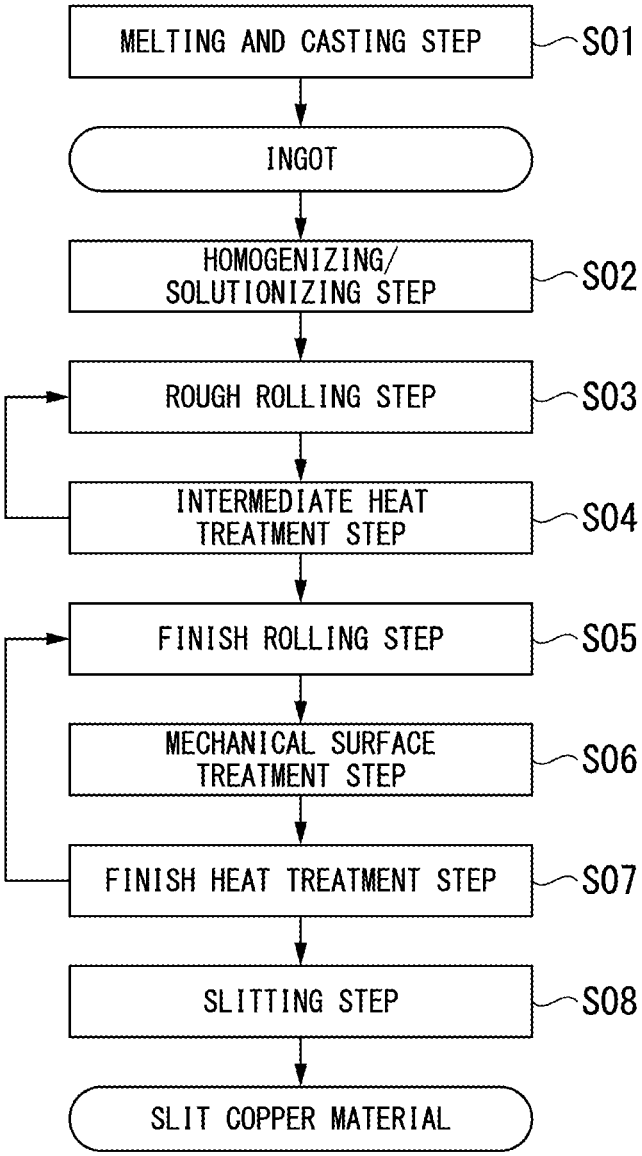
MELTING AND CASTING STEP
S01
INGOT
HOMOGENIZING/
SOLUTIONIZING STEP
S02
ROUGH ROLLING STEP
S03
INTERMEDIATE HEAT
TREATMENT STEP
S04
FINISH ROLLING STEP
S05
MECHANICAL SURFACE
TREATMENT STEP
S06
FINISH HEAT TREATMENT STEP
S07
SLITTING STEP
S08
SLIT COPPER MATERIAL

SLIT COPPER MATERIAL, PART FOR ELECTRIC/ELECTRONIC DEVICE, BUS BAR, HEAT DISSIPATION SUBSTRATE

CROSS-REFERENCE TO RELATED PATENT APPLICATIONS

This application is a U.S. National Phase Application under 35 U.S.C. § 371 of International Patent Application No. PCT/JP2021/038772 filed on Oct. 20, 2021 and claims the benefit of priority to Japanese Patent Applications No. 2020-178070 filed on Oct. 23, 2020 and No. 2021-170961 filed on Oct. 19, 2021, the contents of all of which are incorporated herein by reference in their entireties. The International Application was published in Japanese on Apr. 28, 2022 as International Publication No. WO/2022/085723 under PCT Article 21(2).

FIELD OF THE INVENTION

The present invention relates to a slit copper material suitable for a component for electronic/electrical devices, such as a bus bar or a heat dissipation substrate, a component for electronic/electrical devices, a bus bar, and a heat dissipation substrate, which are formed of this slit copper material.

BACKGROUND OF THE INVENTION

In the related art, copper or a copper alloy with excellent electrical conductivity has been used in a component for electronic/electrical devices such as a bus bar or a heat dissipation substrate.

With an increase in current of electronic devices and electrical devices, in order to reduce the current density and diffuse heat due to Joule heat generation, a pure copper material such as oxygen-free copper with excellent electrical conductivity is used for a component for electronic/electrical devices used for such electronic devices and electrical devices.

However, the pure copper material of the related art has a problem in that bending workability necessary for forming electronic devices, electrical devices, and the like is insufficient and cracking occurs particularly in a case where severe working such as edgewise bending is carried out.

Therefore, Japanese Unexamined Patent Application, First Publication No. 2013-004444 discloses an insulated rectangular copper wire including a rectangular copper wire formed of oxygen-free copper with a 0.2% proof stress of 150 MPa or less.

In the rolled copper plate described in Japanese Unexamined Patent Application, First Publication No. 2013-004444, since the 0.2% proof stress is limited to 150 MPa or less, degradation of voltage endurance characteristics in a bent portion in a case where the edgewise bending has been performed can be prevented.

Meanwhile, recently, a copper material used for the component for electronic/electrical devices is required to further improve the electrical conductivity so that the copper material can be used for applications where the pure copper material has been used, in order to sufficiently prevent heat generation in a case where a high current flows.

Further, since complex bending is performed in some cases, the above-described component for electronic/electrical devices is required to improve the bending workability more than before.

Further, the above-described component for electronic/electrical devices is required to reduce the size and the weight and to sufficiently ensure the strength.

PATENT DOCUMENT

Patent Document 1: Japanese Unexamined Patent Application, First Publication No. 2013-004444

Problems to be Solved by the Invention

The present invention has been made in view of the above-described circumstances, and an objective thereof is to provide a slit copper material having high electrical conductivity, high strength, and excellent bending workability, and a component for electronic/electrical devices, a bus bar, and a heat dissipation substrate, which are formed of this slit copper material.

SUMMARY OF THE INVENTION

Solutions for Solving the Problems

As a result of intensive research conducted by the present inventors in order to achieve the above-described objective, it was found that the crystal texture is required to be appropriately controlled so as to improve the bending workability while the strength is ensured in the slit copper material. That is, it was found that the strength and the bending workability can be further improved more than before in a well-balanced manner by appropriately controlling the crystal grain sizes in a plate center portion and in a plate surface layer portion.

The present invention has been made based on the above-described findings. According to an aspect of the present invention, there is provided a slit copper material, in which a purity of Cu is 99.96% by mass or greater, a ratio W/t of a plate width W to a plate thickness t is 10 or greater, an electrical conductivity is 97.0% IACS or greater, a ratio B/A of an average crystal grain size B in a plate surface layer portion to an average crystal grain size A in a plate center portion is in a range of 0.80 or greater and 1.20 or less, and the average crystal grain size A in the plate center portion is 25 μm or less.

Further, the slit copper material is a material obtained by slitting a copper plate strip material such that the copper plate strip material has a predetermined width.

In the present specification, the plate center portion is defined as a region of 25% to 75% of the total thickness from the surface in the plate thickness direction.

Further, in the present specification, the plate surface layer portion is defined as a region of 0% to 20% of the total thickness from the surface in the plate thickness direction.

According to the slit copper material with the above-described configuration, since the purity of Cu is 99.96% by mass or greater, the electrical conductivity can be ensured, and the electrical conductivity can be set to 97.0% IACS or greater.

Further, since the average crystal grain size A in the plate center portion is set to 25 μm or less, the bending workability and the proof stress can be improved. Further, formation of burrs in a case of slitting can be suppressed, and occurrence of cracking originating from burrs in a case of bending can be suppressed.

In addition, since the ratio B/A of the average crystal grain size B in the plate surface layer portion to the average crystal grain size A in the plate center portion is set to be in a range of 0.80 or greater and 1.20 or less, localized concentration of the stress during working can be suppressed, and the bending workability can be improved.

In the slit copper material according to the aspect of the present invention, it is preferable that the slit copper material contains greater than 10 mass ppm and less than 100 mass ppm of Mg and that a heat-resistant temperature is 150° C. or higher.

In this case, since the amount of Mg is in the above-described range, the strength and the heat resistance can be improved by dissolving Mg into the copper matrix without greatly decreasing the electrical conductivity. Further, since the heat-resistant temperature is set to 150° C. or higher, the slit copper material can be stably used even in a high-temperature environment.

Further, in the slit copper material according to the aspect of the present invention, it is preferable that a 0.2% proof stress in a direction parallel to a rolling direction is greater than 150 MPa.

In this case, the 0.2% proof stress in a direction parallel to the rolling direction is sufficiently high, the formation of burrs in a case of slitting can be suppressed, and the occurrence of cracking originating from burrs in a case of bending can be suppressed.

Further, in the slit copper material according to the aspect of the present invention, it is preferable that analysis is performed while removing a measurement point in which a CI value is 0.1 or less, and a proportion of a number of crystal grains (including twin crystals), in which an aspect ratio b/a represented by a minor axis b and a major axis a of the crystal grain is 0.3 or less, in a total number of measured crystal grains is 90% or less in the plate center portion.

In this case, since the proportion of the number of crystal grains, in which the aspect ratio b/a is 0.3 or less, in the total number of measured crystal grains is 90% or less, the degree of working is suppressed, and the bending workability can be further improved while the proof stress is maintained.

Further, in the slit copper material according to the aspect of the present invention, it is preferable that when the slit copper material is measured by an EBSD method at measurement interval of 1/10 or less of the average crystal grain size A in the plate center portion, measured results in a total measurement area of 10000 $\mu m^2$ or greater in a plurality of visual fields, which are ensured such that a total of 1000 or more crystal grains are included in the plate center portion, are analyzed by data analysis software OIM, a CI value of each measurement point is obtained, the measurement point where the CI value is 0.1 or less is removed, an orientation difference of each crystal grain is analyzed, and a length of a low-angle grain boundary and a subgrain boundary which have 2° or greater and less than 15° of an orientation difference between neighboring measurement points is represented as $L_{LB}$ and a length of a high-angle grain boundary having 15° or greater of an orientation difference between neighboring measurement points is represented as $L_{HB}$, a relationship of $L_{LB}/(L_{LB}+L_{HB})>10\%$ is satisfied.

In this case, since the length of the low-angle grain boundary and the subgrain boundary is sufficiently ensured, a region where the dislocation density is high is ensured, and the strength (proof stress) can be improved by work hardening.

Further, in the slit copper material according to the aspect of the present invention, it is preferable that when a crystal orientation distribution function obtained from texture analysis by the EBSD method in the plate center portion is expressed in terms of an Euler angle, an average value of orientation densities at $\varphi 2=20°$, in a range of $\varphi=20°$ to 50°, and in a range of $\Phi=40°$ to 70° is 1.0 or greater and less than 20.0.

In this case, satisfactory bending workability can be obtained while a higher proof stress is maintained.

Further, in the slit copper material according to the aspect of the present invention, the slit copper material may have a thickness of 0.1 mm or greater and 10 mm or less.

In this case, since the thickness is in a range of 0.1 mm or greater and 10 mm or less, a component for electronic/electrical devices, such as a bus bar or a heat dissipation substrate, can be formed by subjecting the slit copper material to punching or bending.

Further, in the slit copper material according to the aspect of the present invention, it is preferable that the slit copper material includes a metal plating layer on a surface.

In this case, it can also be said that the slit copper material includes a slit copper material main body and a metal plating layer provided on the surface of the slit copper material main body. The slit copper material main body has the same characteristics as those of the slit copper material according to the aspect of the present invention described above. The slit copper material includes the metal plating layer on the surface, and thus is particularly suitable as a material of a component for electronic/electrical devices, such as a bus bar or a heat dissipation substrate.

In addition, examples of the metal plating layer include Sn plating, Ag plating, and Ni plating. Further, according to the aspect of the present invention, the concept of "Sn plating" includes pure Sn plating or Sn alloy plating, the concept of "Ag plating" includes pure Ag plating or Ag alloy plating, and the concept of "Ni plating" includes pure Ni plating or Ni alloy plating.

A component for electronic/electrical devices according to an aspect of the present invention is formed of the slit copper material described above. Further, examples of the component for electronic/electrical devices according to the aspect of the present invention include a bus bar and a heat dissipation substrate.

Since the component for electronic/electrical devices with the above-described configuration is produced by using the slit copper material having high proof stress and excellent bending workability as described above, the size and the weight thereof can be reduced.

A bus bar according to an aspect of the present invention includes the slit copper material described above.

Since the bus bar with the above-described configuration is produced by using the slit copper material having high proof stress and excellent bending workability as described above, the size and the weight thereof can be reduced.

A heat dissipation substrate according to an aspect of the present invention is formed of the slit copper material described above.

Since the heat dissipation substrate with the above-described configuration is produced by using the slit copper material having high proof stress and excellent bending workability as described above, the size and the weight thereof can be reduced.

Effects of Invention

According to the aspect of the present invention, it is possible to provide a slit copper material having high electrical conductivity, high strength, and excellent bending workability, and a component for electronic/electrical devices, a bus bar, and a heat dissipation substrate, which are formed of this slit copper material.

BRIEF DESCRIPTION OF THE DRAWING(S)

The FIGURE is a flow chart showing a method of producing a slit copper material according to the present embodiment.

DETAILED DESCRIPTION OF THE INVENTION

Hereinafter, a slit copper material according to an embodiment of the present invention will be described.

The slit copper material of the present embodiment is a material obtained by slitting a copper plate strip material such that the slit copper material has a predetermined width. In the slit copper material according to the present embodiment, the ratio W/t of the plate width W to the plate thickness t is set to 10 or greater.

The purity of Cu in the slit copper material according to the present embodiment is set to 99.96% by mass or greater.

Further, the slit copper material according to the present embodiment may contain greater than 10 mass ppm and less than 100 mass ppm of Mg.

Therefore, it can also be said that the slit copper material contains: 99.96% by mass or greater of Cu; and greater than 10 mass ppm and less than 100 mass ppm of Mg as an optional element, with the balance of inevitable impurities. Further, Mg may not be intentionally added and Mg may be included as an inevitable impurity, and in this case, the amount of Mg may be 10 mass ppm or less.

Further, in the slit copper material according to the present embodiment, the electrical conductivity is set to 97.0% IACS or greater.

Further, in the slit copper material according to the present embodiment, the ratio B/A of the average crystal grain size B in the plate surface layer portion to the average crystal grain size A in the plate center portion is set to be in a range of 0.80 or greater and 1.20 or less. In addition, the average crystal grain size A in the plate center portion is set to 25 μm or less.

Further, in the present embodiment, the plate center portion is defined as a region of 25% to 75% of the total thickness from the surface in the plate thickness direction. Further, the plate surface layer portion is defined as a region of 0% to 20% of the total thickness from the surface in the plate thickness direction.

Further, in the slit copper material according to the present embodiment, it is preferable that analysis is performed while removing a measurement point in which a CI value is 0.1 or less, and the proportion of the number of crystal grains (including twin crystals), in which an aspect ratio b/a represented by a minor axis b and a major axis a of the crystal grain is 0.3 or less, in the total number of measured crystal grains is 90% or less in the plate center portion.

Further, in the slit copper material according to the present embodiment, the slit copper material is measured by an EBSD method at measurement interval of 1/10 or less of the average crystal grain size A in the plate center portion. The measured results in a total measurement area of 10000 $\mu m^2$ or greater in a plurality of visual fields, which are ensured such that a total of 1000 or more crystal grains are included in the plate center portion, are analyzed by data analysis software OIM, and a CI value of each measurement point is obtained. The measurement point in which a CI value is 0.1 or less is removed. An orientation difference of each crystal grain is analyzed by the data analysis software OIM. A length of a low-angle grain boundary and a subgrain boundary which have 2° or greater and less than 15° of an orientation difference between neighboring measurement points is represented as $L_{LB}$ and a length of a high-angle grain boundary having 15° or greater of an orientation difference between neighboring measurement points is represented as $L_{HB}$. It is preferable that a relationship of $L_{LB}/(L_{LB}+L_{HB})>10\%$ is satisfied.

Further, in the slit copper material according to the present embodiment, it is preferable that when a crystal orientation distribution function obtained from texture analysis by the EBSD method in the plate center portion is expressed in terms of an Euler angle, an average value of orientation densities at $\varphi 2=20°$, in a range of $\varphi 1=20°$ to 50°, and in a range of $\Phi=40°$ to 70° is 1.0 or greater and less than 20.0.

Further, in the slit copper material according to the present embodiment, it is preferable that the 0.2% proof stress in a direction parallel to a rolling direction is greater than 150 MPa.

Moreover, in a case where the slit copper material according to the present embodiment contains Mg, the heat-resistant temperature is preferably 150° C. or higher.

In the slit copper material according to the present embodiment, the reasons for specifying the component composition, the texture, and various characteristics as described above will be described below.

(Cu)

In a case where the amount of Cu is high and the amounts of the impurities are relatively small, the electrical conductivity becomes high. Therefore, in the present embodiment, the amount of Cu is set to 99.96% by mass or greater.

Further, in the slit copper material according to the present embodiment, the amount of Cu is set to preferably 99.97% by mass or greater, more preferably 99.98% by mass or greater, and still more preferably 99.99% by mass or greater in order to further improve the electrical conductivity. The upper limit of the amount of Cu is not particularly limited, but is set to less than 99.9995% by mass because the production cost increases.

(Mg)

Mg is an element having an effect of improving the strength without greatly decreasing the electrical conductivity by dissolving into the copper matrix. Further, the heat-resistant temperature is improved by dissolving Mg into the matrix. Therefore, Mg may be added in order to improve the strength, the heat resistance, and the like.

The above-described effect can be exhibited by setting the amount of Mg to greater than 10 mass ppm. In addition, a decrease in electrical conductivity can be prevented by setting the amount of Mg to less than 100 mass ppm.

Therefore, in the present embodiment, in a case where Mg is added, it is preferable that the amount of Mg is set to greater than 10 mass ppm and less than 100 mass ppm.

In order to further improve the strength, the heat resistance, and the like, the lower limit of the amount of Mg is set to more preferably 20 mass ppm or greater, still more preferably 30 mass ppm or greater, and even still more preferably 40 mass ppm or greater. Further, in order to further prevent a decrease in the electrical conductivity, the upper limit of the amount of Mg is set to more preferably less than 90 mass ppm, still more preferably less than 80 mass ppm, and even still more preferably less than 70 mass ppm.

Further, in a case where Mg is not intentionally added and Mg is included as an impurity, the amount of Mg may be 10 mass ppm or less.

(Other Inevitable Impurities)

Examples of other inevitable impurities other than the above-described elements include Al, Ag, As, B, Ba, Be, Bi, Ca, Cd, Cr, Sc, rare earth elements, V, Nb, Ta, Mo, Ni, W, Mn, Re, Ru, Sr, Ti, Os, P, Co, Rh, Ir, Pb, Pd, Pt, Au, Zn, Zr, Hf, Hg, Ga, In, Ge, Y, Tl, N, S, Sb, Se, Si, Sn, Te, and Li. The slit copper material may contain inevitable impurities within a range not affecting the characteristics.

Since there is a concern that the electrical conductivity is decreased, it is preferable that the amounts of the inevitable impurities are reduced.

(Average Crystal Grain Size a in Plate Center Portion)

In the slit copper material according to the present embodiment, in a case where the average crystal grain size A in the plate center portion (region of 25% to 75% of the total thickness from the surface in the plate thickness direction) is fine, excellent bending workability and high proof stress are obtained. Further, since the formation of burrs in a case of slitting can be suppressed, and the occurrence of cracking originating from burrs in a case of bending can be suppressed.

Therefore, in the present embodiment, the average crystal grain size A in the plate center portion is set to 25 μm or less.

In order to obtain more excellent bending workability and higher proof stress in the slit copper material of the present embodiment, the average crystal grain size A in the plate center portion is set to preferably 20 μm or less and more preferably 15 μm or less. Further, the lower limit of the average crystal grain size A in the plate center portion is not particularly limited, but is substantially 1 μm or greater.

(Ratio B/A of Average Crystal Grain Size B in Plate Surface Layer Portion to Average Crystal Grain Size A in Plate Center Portion)

In the slit copper material according to the present embodiment, in a case where the crystal grain size is non-uniform, the stress is concentrated on grain boundaries of coarse grains during working, localized deformation occurs, and thus occurrence of cracking is accelerated. Therefore, it is necessary to control the crystal grain size to be uniform in the plate thickness direction.

Therefore, in the present embodiment, the ratio B/A of the average crystal grain size B in the plate surface layer portion (region of 0% to 20% of the total thickness from the surface in the plate thickness direction) to the average crystal grain size A in the plate center portion (region of 25% to 75% of the total thickness from the surface in the plate thickness direction) is set to be in a range of 0.80 or greater and 1.20 or less.

In the slit copper material of the present embodiment, the lower limit of the ratio B/A of the average crystal grain size B in the plate surface layer portion to the average crystal grain size A in the plate center portion is preferably 0.82 or greater and more preferably 0.85 or greater. Further, the upper limit of the ratio B/A of the average crystal grain size B in the plate surface layer portion to the average crystal grain size A in the plate center portion is preferably 1.18 or less and more preferably 1.15 or less.

(Aspect Ratio b/a Represented by Minor Axis b and Major Axis a of Crystal Grain in Plate Center Portion)

When the major axis of the crystal grain is represented as a and the minor axis thereof is represented as b, the aspect ratio represented by b/a is an index indicating the degree of working of the material, and the degree of working increases as the proportion of crystal grains with a small aspect ratio increases (that is, crystal grains with a large difference between the major axis a and the minor axis b). In a case where the proportion of the number of crystal grains having an aspect ratio b/a of 0.3 or less in the total number of measured crystal grains is controlled to 90% or less in the plate center portion, the bending workability can be improved while the proof stress is maintained. On the contrary, in a case where the proportion of the number of crystal grains having an aspect ratio b/a of 0.3 or less in the total number of crystal grains is greater than 90%, the proportion of crystals with a high working strain is increased, and thus the bending workability is impaired.

As described above, in the present embodiment, the proportion of the number of crystal grains with an aspect ratio b/a of 0.3 or less is set to be 90% or less of the total number of measured crystal grains. Further, the proportion of the number of crystal grains with an aspect ratio b/a of 0.3 or less is particularly preferably 80% or less and still more preferably 50% or less, even within the above-described range. The lower limit value of the proportion of the number of crystal grains with an aspect ratio b/a of 0.3 or less is not particularly limited, but is preferably 1% or greater.

The CI value (reliability index) obtained by performing analysis using analysis software OIM of an EBSD device decreases in a case where the crystal pattern at the measurement point is not clear, and the analysis result is difficult to trust in a case where the CI value is 0.1 or less. Therefore, in the present embodiment, the measurement points with low reliability in which the CI value is 0.1 or less are removed in the evaluation of the aspect ratio.

(Low-Angle Grain Boundary and Subgrain Boundary Length Ratio: $L_{LB}/(L_{LB}+L_{HB})$)

In grain boundaries, since the low-angle grain boundaries and the subgrain boundaries are regions with a high density of dislocations introduced during working, the strength (proof stress) can be further improved due to work hardening accompanied by an increase in dislocation density by controlling the texture such that the low-angle grain boundary and subgrain boundary length ratio in all grain boundaries $L_{LB}/(L_{LB}+L_{HB})$ is set to greater than 10%.

Further, the low-angle grain boundary and subgrain boundary length ratio $L_{LB}/(L_{LB}+L_{HB})$ is preferably 15% or greater and more preferably 20% or greater, even within the above-described range.

The low-angle grain boundary and subgrain boundary length ratio $L_{LB}/(L_{LB}+L_{HB})$ is preferably 80% or less and more preferably 70% or less in order to impart the sufficient bending workability while maintaining strength (proof stress).

(Average Value of Orientation Densities at $\varphi 2=20°$, in a Range of $\varphi 1=20°$ to 50°, and in a Range of $\Phi=40°$ to 70°)

The Euler angle represents the crystal orientation based on the relationship between the specimen coordinate system and the crystal axes of individual crystal grains, and the crystal orientation is expressed by rotating ($\varphi 1$, $\Phi$, $\varphi 2$) around the (Z-X-Z) axis from a state where crystal axes (X-Y-Z) match each other. The distribution of the crystal orientation density in a measurement range can be confirmed by displaying the crystal orientation distribution function (ODF) in a three-dimensional Eulerian space using a series expansion method. The orientation density distribution defines a completely random orientation state obtained from a standard powder specimen or the like as 1, and for example, in a case where the orientation density in a certain orientation is 3, this means that the orientation density in this certain orientation is three times more present than random orientation.

The orientation densities at φ2=20°, in a range of φ1=20° to 50°, and in a range of Φ=40° to 70° expressed in terms of Euler angles (φ1, Φ, φ2) in the plate center portion are mainly formed by rolling.

In a case where the average value of the above-described orientation densities is 1.0 or greater, a high proof stress can be sufficiently obtained. Further, in a case where the average value of the above-described orientation densities is less than 20.0, satisfactory bending workability can be obtained while the proof stress is maintained.

The lower limit of the average value of the above-described orientation densities is more preferably 1.2 or greater and more preferably 1.5 or greater. Further, the upper limit of the average value of the above-described orientation densities is more preferably 18 or less and still more preferably 15 or less.

(Electrical Conductivity: 97.0% IACS or Greater)

In the copper alloy according to the present embodiment, the electrical conductivity is 97.0% IACS or greater.

The heat generation in a case of electrical conduction is prevented by setting the electrical conductivity to 97.0% IACS or greater so that the slit copper material can be satisfactorily used as a component for electronic/electrical devices such as a terminal, a bus bar, or a heat dissipation substrate as a substitute for a pure copper material of the related art.

Further, the electrical conductivity is preferably 97.5% IACS or greater, more preferably 98.0% IACS or greater, still more preferably 98.5% IACS or greater, and even still more preferably 99.0% IACS or greater. The upper limit value of the electrical conductivity is not particularly limited, but is preferably 103.0% IACS or less.

(0.2% Proof Stress in Direction Parallel to Rolling Direction: Greater than 150 MPa)

In the slit copper material of the present embodiment, in a case where the 0.2% proof stress in a direction parallel to the rolling direction is greater than 150 MPa, formation of burrs in a case of slitting can be suppressed, and occurrence of cracking originating from burrs in a case of bending can be suppressed.

The 0.2% proof stress in a direction parallel to the rolling direction is more preferably 175 MPa or greater and still more preferably 200 MPa or greater.

Particularly, the upper limit of the 0.2% proof stress is not specified, but it is preferable that the 0.2% proof stress is set to 500 MPa or less in order to avoid a decrease in productivity due to a coil set in a case where a coil-wound strip material is used.

(Heat-Resistant Temperature: 150° C. or Higher)

In a case where the heat-resistant temperature is high, a softening phenomenon due to recrystallization is unlikely to occur even at a high temperature; and therefore, the slit copper material according to the present embodiment can be applied to an electric conductive member used in a high-temperature environment.

Therefore, in the present embodiment, it is preferable that the heat-resistant temperature is set to 150° C. or higher.

In the present embodiment, the heat-resistant temperature is measured in conformity with Japan Copper and Brass Association Technical Standard JCBA-T325:2013, and the heating temperature at which the Vickers hardness decreases to 80% of the initial value is measured.

The above-described heat-resistant temperature is more preferably 175° C. or higher, more preferably 200° C. or higher, still more preferably 225° C. or higher, and most preferably 250° C. or higher. The upper limit value of the heat-resistant temperature is not particularly limited, but is preferably 600° C. or lower.

Next, a method of producing the slit copper material according to the present embodiment with such a configuration will be described with reference to the flow chart shown in the drawing.

(Melting and Casting Step S01)

First, a copper raw material is melted to obtain molten copper. Mg is added to adjust the components as necessary. In a case where Mg is added, a single element, a master alloy, or the like can be used. In addition, raw materials containing the above-described elements may be melted together with the copper raw material. Further, a recycled material or a scrap material may be used.

As the copper raw material, so-called 4 N Cu having a purity of 99.99% by mass or greater or so-called 5 N Cu having a purity of 99.999% by mass or greater is preferably used.

In order to reduce the hydrogen concentration in a case of melting, it is preferable that the melting is carried out in an atmosphere using an inert gas atmosphere (for example, Ar gas) in which the vapor pressure of $H_2O$ is low and the holding time for the melting is set to the minimum.

Further, the molten copper in which the components have been adjusted is poured into a mold to produce an ingot. In consideration of mass production, it is preferable to use a continuous casting method or a semi-continuous casting method.

(Homogenizing/Solutionizing Step S02)

Next, a heat treatment is performed for homogenization and solutionization of the obtained ingot. An intermetallic compound or the like generated by segregation and concentration of impurities in the solidification process is present inside the ingot in some cases. Therefore, in order to eliminate or reduce the segregated elements and the intermetallic compound, a heat treatment of heating the ingot to 300° C. or higher and 1080° C. or lower is performed. In this manner, impurities are uniformly diffused in the ingot. In addition, it is preferable that the homogenizing/solutionizing step S02 is performed in a non-oxidizing or reducing atmosphere.

In a case where the heating temperature is lower than 300° C., the solutionization may be incomplete, and a large amount of the intermetallic compound may remain in the matrix. On the contrary, in a case where the heating temperature is higher than 1080° C., a part of the copper material serves a liquid phase, and thus the texture and the surface state may be uneven. Therefore, the heating temperature is set to be in a range of 300° C. or higher and 1080° C. or lower.

Further, hot rolling may be performed after the above-described homogenizing/solutionizing step S02 in order to improve the efficiency of rough rolling and homogenize the texture described below. Further, it is preferable that the hot working temperature is set to be in a range of 300° C. or higher and 1080° C. or lower.

(Rough Rolling Step S03)

In order to work in a predetermined shape, rough rolling is performed. Further, the temperature conditions for this rough rolling step S03 are not particularly limited, but the working temperature is set to be preferably in a range of −200° C. to 200° C., in which cold rolling or warm rolling is carried out, and particularly preferably room temperature for the purpose of suppressing recrystallization or improving the dimensional accuracy. Uniformly recrystallized grains can be obtained in an intermediate heat treatment step S04 described below by uniformly introducing a strain into the material. Therefore, the total working rate is set to preferably 50% or greater, more preferably 60% or greater, and still more preferably 70% or greater. Further, the working rate per pass is set to preferably 20% or greater, more preferably 30% or greater, and still more preferably 40% or greater.

(Intermediate Heat Treatment Step S04)

After the rough rolling step S03, a heat treatment is performed to obtain a recrystallized texture. Further, the rough rolling step S03 and the intermediate heat treatment step S04 may be repeatedly performed.

Since this intermediate heat treatment step S04 is substantially the final recrystallization heat treatment, the crystal grain size of the recrystallized texture obtained in this step is approximately the same as the final crystal grain size. Therefore, in the intermediate heat treatment step S04, it is preferable that the heat treatment conditions are appropriately selected such that the average crystal grain size in the plate center portion is set to 25 μm or less.

Further, in order to set the average value of the orientation densities at φ2=20°, in a range of φ1=20° to 50°, and in a range of Φ=40° to 70° to be 1.0 or greater and less than 20.0, it is preferable that the temperature increase rate in the intermediate heat treatment step S04 is set to 1° C./sec or greater and 50° C./sec or less, the reaching temperature in the step is set to 200° C. or higher and 600° C. or lower, the holding time in the step is set to 10 sec or longer and 500 sec or shorter, and the temperature decrease rate in the step is set to 1° C./sec or greater and 50° C./sec or less.

(Finish Rolling Step S05)

Finish rolling is performed to work the copper material after the intermediate heat treatment step S04 in a predetermined shape. Further, the finish rolling step S05 is performed under a temperature condition of preferably −200° C. to 200° C., at which cold working or warm working is performed, and particularly preferably room temperature for the purpose of suppressing recrystallization during rolling or suppressing a decrease in the low-angle grain boundary and subgrain boundary length ratio.

Further, the rolling rate is appropriately selected such that the shape of the slit copper material is close to the final shape, but it is preferable that the rolling rate is set to 10% or greater for the purpose of increasing the low-angle grain boundary and subgrain boundary length ratio, improving the strength by work hardening, and setting the average value of the orientation densities at φ2=20°, in a range of φ1=20° to 40°, and in a range of Φ=30° to 60° which are the rolled texture to 1.0 or greater in the finish rolling step S05. In order to further improve the strength, the rolling rate is set to more preferably 15% or greater and still more preferably 20% or greater. In addition, the rolling rate is set to preferably 80% or less and more preferably 70% or less for the purpose of suppressing deterioration of the bending workability due to an extreme increase in low-angle grain boundary and subgrain boundary length ratio, suppressing an extreme increase in proportion of the number of crystal grains with an aspect ratio b/a of 0.3 or less, and setting the average value of the orientation densities at φ2=20°, in a range of φ1=20° to 50°, and in a range of Φ=40° to 70° in the rolled texture to less than 20.0.

(Mechanical Surface Treatment Step S06)

A mechanical surface treatment is performed after the finish rolling step S05. The mechanical surface treatment is a treatment of applying a compressive stress to the vicinity of the surface after a desired shape is almost obtained, and has an effect of suppressing the occurrence of cracking during the bending by the compressive stress in the vicinity of the surface and improving the bending workability.

As the mechanical surface treatment, various methods typically used, such as a shot peening treatment, a blast treatment, a lapping treatment, a polishing treatment, buff polishing, grinder polishing, sandpaper polishing, a tension leveler treatment, and light rolling with a low rolling reduction ratio per pass (light rolling is repeatedly performed three times or more by setting the rolling reduction ratio per pass to 1% to 10%) can be used.

(Finish Heat Treatment Step S07)

Next, the copper material obtained by the mechanical surface treatment step S06 may be subjected to a finish heat treatment in order to remove the segregation of contained elements to grain boundaries and the residual strain.

The low-angle grain boundary and subgrain boundary length ratio $L_{LB}/(L_{LB}+L_{HB})$ is greatly decreased in a case where the heat treatment temperature is extremely high, and thus it is preferable that the heat treatment temperature is set to be in a range of 100° C. or higher and 800° C. or lower. Further, in this finish heat treatment step S07, it is necessary to set heat treatment conditions in order to avoid a large decrease in strength due to recrystallization. For example, it is preferable to hold at 200° C. for approximately 0.1 to 100 seconds and preferable to hold at 150° C. for 1 minute to 100 hours. It is preferable that the heat treatment is performed in a non-oxidizing atmosphere or a reducing atmosphere. A method of performing the heat treatment is not particularly limited, but it is preferable that the heat treatment is performed using a continuous annealing furnace for a short period of time from the viewpoint of the effect of reducing the production cost.

Further, the finish rolling step S05, the mechanical surface treatment step S06, and the finish heat treatment step S07 may be repeatedly performed.

In addition, metal plating (such as Sn plating, Ni plating, or Ag plating) may be carried out after the finish heat treatment step S07.

(Slitting Step S08)

The copper material obtained by the finish heat treatment step S07 is subjected to slitting to work the copper material in a desired shape. The slitting is performed by shear working with a slit cutter, but burrs formed in the copper material during the slitting act as a starting point of the stress concentration during working such as the subsequent edgewise bending and thus greatly degrade the workability. In a case where the clearance during the slitting is increased, burrs tend to increase. However, in a case where the clearance during the slitting is excessively small, the entire cut surface of the slit is a sheared surface and no fracture surface is formed, and thus large burrs called plastic burrs are formed. Therefore, the clearance during the slitting is required to have an appropriate value, and the ratio of the clearance to the plate thickness (clearance/plate thickness) is set to preferably 0.5% or greater and 12% or less, more preferably 1% or greater and 10% or less, and most preferably 2% or greater and 8% or less.

Further, after the slitting, deburring may be performed to remove the burrs formed in the slitting. Various commonly used methods such as sandpaper, an abrasive sheet, a rotary bar, an abrasive disc, an abrasive belt, and a blast treatment can be used for deburring.

Further, the slitting may be performed by a precision shearing method to obtain a cut surface without burrs. Specifically, various commonly used methods such as a counter cut method of separating materials by semi-shearing and reverse shearing and a roll slitting method of separating materials by semi-shearing and pressing with a roll.

In this manner, the slit copper material according to the present embodiment is produced.

In a case where the plate thickness of the slit copper material is set to 0.1 mm or greater, the slit copper material is suitable to be used as a conductor for high-current applications. Further, in a case where the plate thickness of the slit copper material is set to 10.0 mm or less, an increase in the load of a press machine can be suppressed, the productivity per unit time can be ensured, and thus the production cost can be reduced.

Therefore, it is preferable that the plate thickness of the slit copper material is set to be in a range of 0.1 mm or greater and 10.0 mm or less.

Further, the lower limit of the plate thickness of the slit copper material is set to preferably 0.5 mm or greater and more preferably 1.0 mm or greater. In addition, the upper limit of the plate thickness of the slit copper material is set to preferably less than 9.0 mm and more preferably less than 8.0 mm.

In the slit copper material according to the present embodiment with the above-described configuration, since the purity of Cu is set to 99.96% by mass or greater, the electrical conductivity can be ensured, and the electrical conductivity can be set to 97.0% IACS or greater.

Further, since the average crystal grain size A in the plate center portion is set to 25 μm or less, the bending workability and the proof stress can be improved. Further, formation of burrs in a case of slitting can be suppressed, and occurrence of cracking originating from burrs in a case of bending can be suppressed.

In addition, since the ratio B/A of the average crystal grain size B in the plate surface layer portion to the average crystal grain size A in the plate center portion is set to be in a range of 0.80 or greater and 1.20 or less, localized concentration of the stress during working can be suppressed, and the bending workability can be improved.

Further, in a case where the slit copper material according to the present embodiment contains greater than 10 mass ppm and less than 100 mass ppm of Mg, the strength and the heat resistance can be improved by dissolving Mg into the copper matrix without greatly decreasing the electrical conductivity.

Further, in a case where the heat-resistant temperature of the slit copper material according to the present embodiment is set to 150° C. or higher, the slit copper material can be used stably even in a high-temperature environment.

In the slit copper material according to the present embodiment, in a case where the 0.2% proof stress in a direction parallel to the rolling direction is greater than 150 MPa, formation of burrs in a case of slitting can be further suppressed, and occurrence of cracking originating from burrs in a case of bending can be suppressed.

Further, in the slit copper material according to the present embodiment, when analysis is performed while removing a measurement point in which a CI value is 0.1 or less, and the proportion of the number of crystal grains (including twin crystals), in which an aspect ratio b/a represented by a minor axis b and a major axis a of the crystal grain is 0.3 or less, in the total number of measured crystal grains is 90% or less in the plate center portion, the degree of working is suppressed, and the bending workability can be further improved while the proof stress is maintained.

Further, in the slit copper material according to the present embodiment, the slit copper material is measured by an EBSD method at measurement interval of 1/10 or less of the average crystal grain size A in the plate center portion. The measured results in a total measurement area of 10000 $\mu m^2$ or greater in a plurality of visual fields, ensured such that a total of 1000 or more crystal grains are included in the plate center portion, are analyzed by data analysis software OIM, and a CI value of each measurement point is obtained. The measurement point in which a CI value is 0.1 or less is removed. An orientation difference of each crystal grain is analyzed by the data analysis software OIM. A length of a low-angle grain boundary and a subgrain boundary which have 2° or greater and less than 15° of an orientation difference between neighboring measurement points is represented as $L_{LB}$ and a length of a high-angle grain boundary having 15° or greater of an orientation difference between neighboring measurement points is represented as $L_{HB}$. In a case where a relationship of $L_{LB}/(L_{LB}+L_{HB})>10\%$ is satisfied, a region where the dislocation density is high is ensured, and the strength (proof stress) can be improved by work hardening.

In the slit copper material according to the present embodiment, in a case where the average value of the orientation densities at $\varphi2=20°$, in a range of $\varphi1=20°$ to 50°, and in a range of $\Phi=40°$ to 70° in the plate center portion is 1.0 or greater and less than 20.0, satisfactory bending workability can be obtained while a higher proof stress is maintained.

Further, in a case where the slit copper material according to the present embodiment has a thickness of 0.1 mm or greater and 10 mm or less, a component for electronic/electrical devices, such as a bus bar or a heat dissipation substrate, can be formed by subjecting the slit copper material to punching or bending.

Further, in a case where a metal plating layer is formed on the surface of the slit copper material according to the present embodiment, the slit copper material is particularly suitable as a material of a component for electronic/electrical devices, such as a bus bar or a heat dissipation substrate.

Since the component for electronic/electrical devices, the bus bar, and the heat dissipation substrate according to the above-described embodiment are produced by using the slit copper material having high proof stress and excellent bending workability as described above, the size and the weight thereof can be reduced.

Hereinbefore, the slit copper material and the component for electronic/electrical devices (such as a bus bar or a heat dissipation substrate) according to the embodiment of the present invention have been described, but the present invention is not limited thereto and can be appropriately changed within a range not departing from the technical features of the invention.

For example, in the above-described embodiment, the example of the method of producing the slit copper material has been described, but the method of producing the copper alloy is not limited to the description of the embodiment, and the slit copper material may be produced by appropriately selecting a production method of the related art.

EXAMPLES

Hereinafter, results of a verification test conducted to verify the effects of the present invention will be described.

A raw material consisting of so-called 3 N Cu having a purity of 99.9% by mass or greater or a raw material consisting of so-called 5 N Cu having a purity of 99.999% by mass or greater, which had been obtained by a zone melting refining method, was put into a high-purity graphite crucible and subjected to high-frequency induction melting in an atmosphere furnace having an Ar gas atmosphere; and thereby, molten copper was obtained.

Further, in a case of adding Mg, a master alloy containing 0.1% by mass of Mg was prepared by using high-purity copper having a purity of 6 N (purity of 99.9999% by mass) or greater and a pure metal having a purity of 2 N (purity of 99% by mass) or greater. The master alloy was added to the obtained molten copper to adjust the components.

Further, an ingot having the component composition listed in Tables 1 and 2 was produced by pouring the molten copper obtained in the above-described manner into a heat insulating material (refractory material) mold. Further, the size of the ingot was set such that the thickness was approximately 30 mm, the width was approximately 500 mm, and the length was approximately in a range of 150 to 200 mm.

The obtained ingot was heated at 900° C. for 1 hour in an Ar gas atmosphere, and the surface was ground to remove the oxide film, and the ingot was cut into a predetermined size.

Thereafter, the thickness of the ingot was appropriately adjusted to obtain the final thickness, and the ingot was cut. Each of the cut specimens was subjected to rough rolling under the conditions listed in Tables 1 and 2. Next, an intermediate heat treatment was performed under the conditions listed in Tables 1 and 2.

Next, finish rolling (finish working step) was performed under the conditions listed in Tables 1 and 2.

Next, these specimens were subjected to a mechanical surface treatment step by the method listed in Tables 1 and 2.

Further, the buff polishing was performed using #800 abrasive paper.

Further, sandpaper polishing was performed using #240 abrasive paper.

The grinder polishing was performed using a #400 bearing wheel at a speed of 4500 revolutions per minute.

Thereafter, a finish heat treatment was performed under the conditions listed in Tables 1 and 2. Next, slitting or slitting of a precision shearing method (a counter cut method and a roll slitting method) was performed under the condition that the clearance/plate thickness ratio was in a range of 2% to 8%, and a slit copper material was produced such that the plate thicknesses t and the ratio W/t of the plate width W to the plate thickness t were as listed in Tables 1 and 2.

The obtained slit copper materials were evaluated for the following items.

(Composition Analysis)

Measurement specimens were collected from the obtained ingot, the amount of Mg was measured by inductively coupled plasma atomic emission spectrophotometry, and the amount of Cu was measured by copper electrogravimetry (JIS H 1051). Further, the measurement was performed at two sites, which were the center portion of the specimen and the end portion of the specimen in the width direction, and the larger amount was defined as the amount of the sample. As a result, it was confirmed that the component compositions were as listed in Tables 1 and 2.

(Average Crystal Grain Size)

A sample with a width of 20 mm and a length of 20 mm was cut out from the obtained slit copper material, and the average crystal grain size was measured by an electron backscatter diffraction patterns (SEM-EB SD) measuring device.

A surface perpendicular to the width direction of rolling, that is, a transverse direction (TD) surface was used as an observation surface, and the surface was mechanically polished using waterproof abrasive paper and diamond abrasive grains. Next, finish polishing was performed using a colloidal silica solution; and thereby, a sample for measurement was obtained. Thereafter, the observation surface was measured in a measurement area of 10000 $\mu m^2$ or greater at measurement interval of 0.25 μm at an electron beam acceleration voltage of 15 kV by an EBSD method using an EBSD measuring device (Quanta FEG 450, manufactured by FEI, OIM Data Collection, manufactured by EDAX/TSL (currently AMETEK)) and analysis software (OIM Data Analysis ver. 7.3.1, manufactured by EDAX/TSL (currently AMETEK)). The measured results were analyzed by the data analysis software OIM to obtain CI value at each measurement point. The measurement points with a CI value of 0.1 or less were excluded, and the orientation difference between crystal grains was analyzed by the data analysis software OIM by excluding the measurement points with a CI value of 0.1 or less. Further, a boundary having 15° or greater of an orientation difference between neighboring measurement points was assigned as a high-angle grain boundary, and a boundary having less than 15° of an orientation difference between neighboring measurement points was assigned as a low-angle grain boundary. The twin crystal boundaries were also assigned as high-angle grain boundaries. Further, the measurement range was adjusted such that each sample contained 100 or more crystal grains. A crystal grain boundary map was created using the high-angle grain boundaries based on the obtained orientation analysis results. Five line segments with a predetermined vertical length and five line segments with a predetermined horizontal length were drawn on the crystal grain boundary map in conformity with the cutting method of JIS H 0501, the number of crystal grains that were completely cut was counted, and the average value was obtained by dividing the total cut length (length of the line segments cut off by the crystal grain boundaries) by the number of crystal grains. The average value was defined as the average crystal grain size.

Next, the average crystal grain size A in the plate center portion (region of 25% to 75% of the total thickness from the surface in the plate thickness direction) and the average crystal grain size B in the plate surface layer portion (region of 0% to 20% of the total thickness from the surface in the plate thickness direction) were calculated.

(Aspect Ratios of Crystal Grains)

The aspect ratios of crystal grains were measured using the crystal grain boundary map described above.

Five line segments were drawn in the plate thickness direction and five line segments were drawn in the rolling direction with respect to each of all crystal grains. In the line segments drawn in the rolling direction, the average length of the line segments cut off by the crystal grain boundary was defined as the major axis a. In the line segments drawn in the plate thickness direction, the average length of the line segments cut off by the crystal grain boundary was defined as the minor axis b. The aspect ratios b/a of all the crystal grains were calculated, and the aspect ratio b/a was the ratio of the length of the minor axis b to the length of the major axis a.

Further, the proportion of crystal grains having an aspect ratio b/a of 0.3 or less was obtained.

(Low-Angle Grain Boundary and Subgrain Boundary Length Ratio)

The low-angle grain boundary and subgrain boundary length ratio was acquired by measuring the observation surface (TD surface) at measurement interval, which was 1/10 or less of the average crystal grain size A in the plate center portion, at an electron beam acceleration voltage of 15 kV with an EBSD measuring device and OIM analysis software using the sample for measurement.

The measured results in a total measurement area of 10000 $\mu m^2$ or greater in a plurality of visual fields, ensured such that a total of 1000 or more crystal grains were included in the plate center portion, were analyzed by data analysis software OIM, and a CI value of each measurement point was obtained. The measurement points in which the CI value was 0.1 or less were removed, and the orientation difference between crystal grains was analyzed by the data analysis software OIM. A boundary having 2° or greater and less than 15° of an orientation difference between neighboring measurement points was assigned as a low-angle grain boundary and a subgrain boundary and the length thereof was represented as $L_{LB}$. A boundary having 15° or greater of an orientation difference between neighboring measurement points was assigned as a high-angle grain boundary, and the length thereof was represented as $L_{HB}$. The low-angle grain boundary and subgrain boundary length ratio $L_{LB}/(L_{LB}+L_{HB})$ in all grain boundaries was acquired.

(Orientation Density)

The orientation density was measured based on the above-described measured results. That is, the results obtained by measuring the observation surface (TD surface) using an EBSD measuring device and OIM analysis software in a case of acquiring the low-angle grain boundary and subgrain boundary length ratio were used.

The measured results were analyzed by the data analysis software OIM; and thereby, the CI value at each measurement point was obtained. The measurement points in which the CI value was 0.1 or less were removed, and the texture was analyzed by the data analysis software OIM to obtain the crystal orientation distribution function.

The crystal orientation distribution function obtained by the analysis was expressed in terms of an Euler angle. Further, the average value of the orientation densities at $\varphi 2=20°$, in a range of $\varphi 1=20°$ to 50°, and in a range of $\Phi=40°$ to 70° was acquired.

(Mechanical Properties)

#13B test pieces specified in JIS Z 2241 were collected from each strip material for characteristic evaluation and the 0.2% proof stress was measured according to the offset method in JIS Z 2241. Further, the test pieces were collected in a direction parallel to the rolling direction.

(Electrical Conductivity)

Test pieces having a width of 10 mm and a length of 60 mm were collected from each strip material for characteristic evaluation and the electric resistance was acquired according to a 4 terminal method. Further, the dimension of each test piece was measured using a micrometer and the volume of the test piece was calculated. In addition, the electrical conductivity was calculated from the measured electric resistance value and volume. Further, the test pieces were collected such that the longitudinal directions thereof were parallel to the rolling direction of each strip material for characteristic evaluation. The evaluation results are listed in Tables 3 and 4.

(Heat-Resistant Temperature)

The heat-resistant temperature (temperature at which the hardness decreased to 80% of the initial value) was evaluated by obtaining an isochrone softening curve using the Vickers hardness after one hour of the heat treatment in conformity with JCBA T325:2013 of Japan Copper and Brass Association. Further, the rolled surface was used as the measurement surface for the Vickers hardness. The evaluation results are listed in Tables 3 and 4.

(Bending Workability)

Edgewise bending was performed under the condition that the ratio (R/W) of the inner curvature radius (R) to the plate width (W) was set to the value listed in Tables 3 and 4, and the bent portion of the outer peripheral side surface was observed.

A case where wrinkles were not found was evaluated as "A" (excellent), a case where wrinkles were found was evaluated as "B" (good), a case where small cracks were found was evaluated as "C" (fair), and a case where the bent portion was fractured and edgewise bending could not be performed was evaluated as "D" (poor). The evaluation results A to C were determined as acceptable bending workability.

TABLE 1

| | | Component composition (mass ratio) | | Production step: Rough rolling | Intermediate heat treatment: Temperature increasing | Intermediate heat treatment: Reaching temperature | Intermediate heat treatment: Time | Intermediate heat treatment: Temperature decreasing | Finish rolling | Mechanical surface treatment | Slitting | Finish heat treatment | | Plate thickness | Ratio W/t of plate width W to plate thickness |
|---|---|---|---|---|---|---|---|---|---|---|---|---|---|---|---|
| | | Cu % | Mg ppm | Rolling rate % | rate ° C./sec. | ° C. | sec. | rate ° C./sec. | Rolling rate % | Working method | Working method | Temperature ° C. | Time sec. | t mm | t |
| Invention Examples | 1 | 99.96 | — | 70 | 20 | 250 | 120 | 20 | 50 | Grinder polishing | Conventional slitting | 210 | 40 | 2.0 | 10 |
| | 2 | 99.97 | — | 65 | 20 | 350 | 150 | 20 | 40 | Sandpaper polishing | Conventional slitting | 150 | 14400 | 3.0 | 10 |
| | 3 | 99.98 | — | 75 | 40 | 300 | 10 | 40 | 40 | Buff polishing | Conventional slitting | 260 | 1 | 0.1 | 200 |
| | 4 | 99.99 | — | 65 | 20 | 250 | 60 | 20 | 15 | Sandpaper polishing | Conventional slitting | 200 | 60 | 1.0 | 20 |
| | 5 | 99.99 | — | 80 | 40 | 600 | 10 | 40 | 10 | Buff polishing | Conventional slitting | 190 | 250 | 0.5 | 100 |
| | 6 | 99.99 | — | 75 | 5 | 500 | 250 | 5 | 15 | Buff polishing | Conventional slitting | 160 | 7200 | 5.0 | 10 |

TABLE 1-continued

| | | Component composition (mass ratio) | | Production step | | | | | | | | | | | | Ratio W/t of plate width W to plate thickness t |
|---|---|---|---|---|---|---|---|---|---|---|---|---|---|---|---|---|
| | | | | Rough rolling | Intermediate heat treatment | | | | Finish rolling | Mechanical surface treatment | | Finish heat treatment | | Plate thickness | | |
| | | Cu % | Mg ppm | Rolling rate % | Temperature increasing rate ° C./sec. | Reaching temperature ° C. | Time sec. | Temperature decreasing rate ° C./sec. | Rolling rate % | Working method | Working method | Temperature ° C. | Time sec. | t mm | | |
| | 7 | 99.99 | — | 75 | 5 | 550 | 350 | 5 | 15 | Buff polishing | Conventional slitting | 200 | 100 | 6.0 | 10 |
| | 8 | 99.99 | — | 80 | 1 | 500 | 10 | 1 | 10 | Sandpaper polishing | Conventional slitting | 110 | 360000 | 0.2 | 100 |
| | 9 | 99.99 | — | 80 | 5 | 550 | 350 | 5 | 0 | Buff polishing | Conventional slitting | — | — | 5.0 | 10 |
| Invention Examples | 10 | 99.99 | — | 70 | 1 | 500 | 500 | 1 | 30 | Grinder polishing | Conventional slitting | 240 | 5 | 6.0 | 10 |
| | 11 | 99.99 | — | 80 | 1 | 450 | 400 | 1 | 40 | Grinder polishing | Conventional slitting | 210 | 40 | 3.0 | 10 |
| | 12 | 99.99 | — | 50 | 20 | 200 | 120 | 20 | 30 | Buff polishing | Conventional slitting | — | — | 2.0 | 20 |
| | 13 | 99.99 | — | 75 | 5 | 450 | 250 | 5 | 30 | Sandpaper polishing | Conventional slitting | 200 | 100 | 5.0 | 10 |
| | 14 | 99.99 | — | 65 | 20 | 300 | 60 | 20 | 80 | Grinder polishing | Conventional slitting | 260 | 1 | 1.0 | 20 |
| | 15 | 99.99 | — | 50 | 20 | 250 | 120 | 20 | 70 | Buff polishing | Conventional slitting | 180 | 600 | 2.0 | 10 |
| | 16 | 99.99 | — | 75 | 40 | 350 | 60 | 40 | 80 | Grinder polishing | Conventional slitting | — | — | 0.8 | 50 |
| | 17 | 99.99 | — | 80 | 40 | 600 | 10 | 40 | 10 | Buff polishing | Counter cut method | 190 | 250 | 0.5 | 100 |
| | 18 | 99.99 | — | 75 | 5 | 500 | 250 | 5 | 15 | Buff polishing | Counter cut method | 160 | 7200 | 5.0 | 10 |

TABLE 2

| | | Component composition (mass ratio) | | Production step | | | | | | | | | | | | Ratio W/t of plate width W to plate thickness t |
|---|---|---|---|---|---|---|---|---|---|---|---|---|---|---|---|---|
| | | | | Rough rolling | Intermediate heat treatment | | | | Finish rolling | Mechanical surface treatment | | Finish heat treatment | | Plate thickness | | |
| | | Cu % | Mg ppm | Rolling rate % | Temperature increasing rate ° C./sec. | Reaching temperature ° C. | Time sec. | Temperature decreasing rate ° C./sec. | Rolling rate % | Working method | Working method | Temperature ° C. | Time sec. | t mm | | |
| Invention Examples | 19 | 99.99 | — | 75 | 5 | 550 | 350 | 5 | 15 | Buff polishing | Roll slitting method | 200 | 100 | 6.0 | 10 |
| | 20 | 99.99 | — | 80 | 1 | 500 | 10 | 1 | 10 | Sandpaper polishing | Roll slitting method | 110 | 360000 | 0.2 | 100 |
| | 21 | 99.99 | — | 70 | 40 | 300 | 60 | 40 | 95 | Grinder polishing | Conventional slitting | 260 | 1 | 0.1 | 100 |
| | 22 | 99.99 | — | 60 | 5 | 200 | 250 | 5 | 20 | Grinder polishing | Conventional slitting | 140 | 50000 | 5.0 | 10 |
| | 23 | 99.99 | — | 80 | 1 | 400 | 450 | 1 | 10 | Sandpaper polishing | Conventional slitting | 100 | 360000 | 5.0 | 10 |
| | 24 | 99.99 | — | 60 | 5 | 250 | 250 | 5 | 10 | Grinder polishing | Conventional slitting | 260 | 1 | 5.0 | 10 |
| | 25 | 99.99 | 12 | 70 | 5 | 350 | 200 | 5 | 50 | Buff polishing | Conventional slitting | 220 | 20 | 4.0 | 10 |
| | 26 | 99.99 | 23 | 60 | 1 | 300 | 300 | 1 | 30 | Buff polishing | Conventional slitting | 200 | 100 | 6.0 | 10 |

TABLE 2-continued

| | | Component composition (mass ratio) | | Production step | | | | | | | | | | | | Ratio W/t of plate width W to plate thickness t |
|---|---|---|---|---|---|---|---|---|---|---|---|---|---|---|---|---|
| | | | | | Intermediate heat treatment | | | | | | | | Finish heat treatment | | | |
| | | Cu % | Mg ppm | Rough rolling Rolling rate % | Temperature increasing rate ° C./sec. | Reaching temperature ° C. | Time sec. | Temperature decreasing rate ° C./sec. | Finish rolling Rolling rate % | Mechanical surface treatment Working method | Slitting Working method | Temperature ° C. | Time sec. | Plate thickness t mm | |
| Invention Examples | 27 | 99.99 | 31 | 70 | 5 | 450 | 250 | 5 | 30 | Grinder polishing | Conventional slitting | 230 | 10 | 5.0 | 10 |
| | 28 | 99.99 | 46 | 50 | 20 | 300 | 120 | 20 | 60 | Sandpaper polishing | Conventional slitting | 150 | 14400 | 2.0 | 20 |
| | 29 | 99.98 | 73 | 70 | 5 | 400 | 250 | 5 | 20 | Buff polishing | Conventional slitting | — | — | 5.0 | 10 |
| | 30 | 99.98 | 83 | 75 | 20 | 400 | 60 | 20 | 30 | Grinder polishing | Conventional slitting | 110 | 360000 | 1.0 | 20 |
| | 31 | 99.98 | 92 | 65 | 5 | 400 | 250 | 5 | 30 | Sandpaper polishing | Conventional slitting | 180 | 600 | 5.0 | 10 |
| Comparative Examples | 1 | 99.76 | 2300 | 70 | 5 | 500 | 300 | 5 | 20 | Sandpaper polishing | Conventional slitting | 180 | 600 | 5.0 | 10 |
| | 2 | 99.99 | — | 80 | 20 | 900 | 120 | 20 | 30 | Grinder polishing | Conventional slitting | 800 | 60 | 2.0 | 10 |
| | 3 | 99.99 | — | 30 | 1 | 350 | 120 | 1 | 40 | Buff polishing | Conventional slitting | 170 | 1700 | 0.1 | 200 |

TABLE 3

| | | Average crystal grain size A in plate center portion μm | Average crystal grain size B in plate surface layer portion μm | B/A | Proportion of number of crystal grains with aspect ratio of 0.3 or less % | $L_{LB}/(L_{LB}+L_{HB})$ % | Average value of orientation densities at φ2 = 20°, in range of φ1 = 20° to 50°, and in range of Φ = 40° to 70° | GW proof stress MPa | Electrical conductivity % IACS | Heat-resistant temperature ° C. | Ratio R/W of inner curvature radius R to plate width W | Bending workability |
|---|---|---|---|---|---|---|---|---|---|---|---|---|
| Invention Examples | 1 | 7 | 8 | 1.14 | 71 | 53 | 15 | 278 | 97.1 | 192 | 2.50 | A |
| | 2 | 8 | 8 | 1.00 | 52 | 42 | 11 | 235 | 97.6 | 198 | 2.00 | A |
| | 3 | 9 | 9 | 1.00 | 58 | 35 | 9 | 206 | 98.2 | 220 | 2.00 | A |
| | 4 | 8 | 8 | 1.00 | 42 | 22 | 3 | 175 | 100.3 | 227 | 1.50 | A |
| | 5 | 24 | 21 | 0.88 | 43 | 11 | 1 | 151 | 100.1 | 253 | 1.00 | B |
| | 6 | 17 | 15 | 0.88 | 43 | 13 | 2 | 153 | 100.1 | 251 | 1.00 | B |
| | 7 | 18 | 17 | 0.94 | 42 | 14 | 2 | 152 | 100.2 | 249 | 1.00 | B |
| | 8 | 18 | 17 | 0.94 | 42 | 12 | 2 | 154 | 99.9 | 249 | 1.00 | B |
| | 9 | 20 | 20 | 1.00 | 41 | 6 | 1 | 137 | 100.9 | 151 | 0.80 | C |
| | 10 | 16 | 13 | 0.81 | 49 | 31 | 8 | 198 | 99.9 | 225 | 1.00 | B |
| | 11 | 16 | 19 | 1.19 | 51 | 42 | 12 | 262 | 100.2 | 189 | 1.00 | B |
| | 12 | 6 | 7 | 1.17 | 47 | 55 | 14 | 298 | 99.9 | 179 | 1.00 | B |
| | 13 | 12 | 10 | 0.83 | 48 | 39 | 10 | 215 | 100.1 | 211 | 1.00 | B |
| | 14 | 8 | 8 | 1.00 | 89 | 80 | 19 | 357 | 98.9 | 153 | 1.00 | B |
| | 15 | 7 | 8 | 1.14 | 87 | 69 | 18 | 352 | 98.4 | 155 | 1.00 | B |
| | 16 | 9 | 8 | 0.89 | 90 | 78 | 19 | 362 | 97.4 | 154 | 1.00 | B |
| | 17 | 23 | 20 | 0.87 | 45 | 12 | 2 | 153 | 100.0 | 251 | 0.80 | A |
| | 18 | 17 | 14 | 0.82 | 44 | 14 | 3 | 155 | 100.0 | 249 | 0.60 | A |

TABLE 4

| | | Average crystal grain size A in plate center portion μm | Average crystal grain size B in plate surface layer portion μm | B/A | Proportion of number of crystal grains with aspect ratio of 0.3 or less % | $L_{LB}/(L_{LB}+L_{HB})$ % | Average value of orientation densities at φ2 = 20°, in range of φ1 = 20° to 50°, and in range of Φ = 40° to 70° | GW proof stress MPa | Electrical conductivity % IACS | Heat-resistant temperature ° C. | Ratio R/W of inner curvature radius R to plate width W | Bending workability |
|---|---|---|---|---|---|---|---|---|---|---|---|---|
| Invention Examples | 19 | 19 | 17 | 0.89 | 43 | 15 | 2 | 153 | 100.1 | 248 | 0.67 | A |
| | 20 | 19 | 17 | 0.89 | 43 | 13 | 2 | 155 | 99.7 | 247 | 1.00 | A |
| | 21 | 8 | 7 | 0.88 | 92 | 81 | 22 | 369 | 97.1 | 152 | 0.70 | C |
| | 22 | 7 | 6 | 0.86 | 49 | 13 | 2 | 154 | 99.9 | 232 | 1.20 | A |
| | 23 | 12 | 11 | 0.92 | 47 | 11 | 1 | 153 | 100.2 | 232 | 2.00 | A |
| | 24 | 8 | 8 | 1.00 | 48 | 11 | 1 | 151 | 100.3 | 236 | 1.40 | A |
| | 25 | 8 | 7 | 0.88 | 65 | 51 | 13 | 275 | 99.6 | 204 | 1.25 | A |
| | 26 | 8 | 9 | 1.13 | 47 | 42 | 9 | 352 | 99.4 | 226 | 1.33 | A |
| | 27 | 13 | 12 | 0.92 | 48 | 41 | 10 | 302 | 99.3 | 281 | 1.20 | A |
| | 28 | 7 | 7 | 1.00 | 74 | 49 | 14 | 351 | 99.1 | 322 | 1.25 | A |
| | 29 | 9 | 8 | 0.89 | 41 | 27 | 5 | 366 | 97.3 | 324 | 1.40 | A |
| | 30 | 9 | 8 | 0.89 | 49 | 49 | 11 | 369 | 98.5 | 327 | 1.50 | A |
| | 31 | 8 | 7 | 0.88 | 48 | 40 | 10 | 388 | 98.4 | 330 | 1.20 | A |
| Comparative Examples | 1 | 8 | 7 | 0.88 | 42 | 45 | 12 | 342 | 82.3 | 406 | 1.20 | B |
| | 2 | 120 | 121 | 1.01 | 39 | 22 | 3 | 142 | 100.1 | 150 | 2.50 | D |
| | 3 | 9 | 34 | 3.78 | 48 | 33 | 10 | 151 | 100.1 | 201 | 2.00 | D |

In Comparative Example 1, the amount of Cu was 99.76% by mass which was low, and the electrical conductivity was 82.3% IACS which was low.

In Comparative Example 2, the average crystal grain size A in the plate center portion was 120 μm which was high, and the proof stress in the direction parallel to the rolling direction was 142 MPa which was low. In addition, the bending workability was evaluated as "D".

In Comparative Example 3, the ratio B/A of the average crystal grain size A in the plate center portion to the average crystal grain size B in the plate surface layer portion was 3.78, and the bending workability was evaluated as "D".

On the contrary, in Invention Examples 1 to 31, it was confirmed that the electrical conductivity, the strength, the heat resistance, and the bending workability were excellent.

As shown in the results described above, according to Invention Examples, it was confirmed that a slit copper material having high electrical conductivity, high strength, and excellent bending workability can be provided.

INDUSTRIAL APPLICABILITY

The slit copper material of the present embodiment is suitably applied to a component for electronic/electrical devices, a bus bar, and a heat dissipation substrate.

What is claimed is:

1. A slit copper material, comprising:

Cu in an amount of 99.96% by mass or greater, wherein a ratio W/t of a plate width W to a plate thickness t is 10 or greater, an electrical conductivity is 97.0% IACS or greater, a ratio B/A of an average crystal grain size B in a plate surface layer portion to an average crystal grain size A in a plate center portion is in a range of 0.80 or greater and 1.20 or less, the surface layer portion being a region of 0% to 20% of the plate thickness, and the plate center portion being a region of 25% to 75% of the plate thickness, the average crystal grain size A in the plate center portion is 25 μm or less, and when edgewise bending is performed as an evaluation of bending workability under condition that a ratio R/W of an inner curvature radius R to the plate width W is set to 2.50, a bent portion is not fractured.

2. The slit copper material according to claim 1, further comprising:

Mg in an amount of 12 mass ppm or greater and less than 100 mass ppm, wherein the slit copper material has a heat-resistant temperature in a range of 150° C. or higher.

3. The slit copper material according to claim 1, wherein a 0.2% proof stress in a direction parallel to a rolling direction is greater than 150 MPa.

4. The slit copper material according to claim 1, wherein analysis is performed while removing a measurement point in which a CI value is 0.1 or less, and a proportion of a number of crystal grains (including twin crystals), in which an aspect ratio b/a represented by a minor axis b and a major axis a of the crystal grain is 0.3 or less, in a total number of measured crystal grains is 90% or less in the plate center portion.

5. The slit copper material according to claim 1, wherein when the slit copper material is measured by an EBSD method at measurement interval of 1/10 or less of the average crystal grain size A in the plate center portion, measured results in a total measurement area of 10000 $\mu m^2$ or greater in a plurality of visual fields, which are ensured such that a total of 1000 or more crystal grains are included in the plate center portion, are analyzed by data analysis software OIM, a CI value of each measurement point is obtained, the measurement point where the CI value is 0.1 or less is removed, an orientation difference of each crystal grain is analyzed, and a length of a low-angle grain boundary and a subgrain boundary which have 2° or greater and less than 15° of an orientation difference between neighboring measurement points is represented as $L_{LB}$ and a length of a high-angle grain boundary having 15° or greater of an orientation difference between neighboring measurement points is represented as $L_{HB}$, a relationship of $L_{LB}/(L_{LB}+L_{HB})>10\%$ is satisfied.

6. The slit copper material according to claim 1, wherein when a crystal orientation distribution function obtained from texture analysis by the EBSD method in the plate center portion is expressed in terms of an Euler angle, an average value of orientation densities at $\varphi 2=20°$ in a range of $\varphi 1=20°$ to 50°, and in a range of $\Phi=40°$ to 70° is 1.0 or greater and less than 20.0.

7. The slit copper material according to claim 1, wherein the slit copper material has a thickness of 0.1 mm or greater and 10 mm or less.

8. The slit copper material according to claim 1, further comprising:

a metal plating layer on a surface.

9. A component for electronic/electrical devices, which is formed of the slit copper material according to claim 1.

10. A bus bar comprising:

the slit copper material according to claim 1.

11. A heat dissipation substrate, which is formed of the slit copper material according to claim 1.

* * * * *